United States Patent [19]

Schlueter

[11] 3,991,640

[45] Nov. 16, 1976

[54] PACKAGE FORMING MACHINE

[75] Inventor: David Frederick Schlueter, Hoopeston, Ill.

[73] Assignee: Illinois Tool Works Inc., Chicago, Ill.

[22] Filed: Jan. 21, 1976

[21] Appl. No.: 651,104

[52] U.S. Cl. ..... 83/341; 83/356.3; 53/48

[51] Int. Cl.[2] ..... B26D 1/56; B65B 21/00

[58] Field of Search ..... 83/340, 341, 342, 331, 83/356.3; 53/48

[56] References Cited

UNITED STATES PATENTS

| | | | |
|---|---|---|---|
| 627,462 | 6/1899 | Legg | 83/340 X |
| 3,150,552 | 9/1964 | Heijnis | 83/341 X |
| 3,204,386 | 9/1965 | Creed et al. | 53/48 |

*Primary Examiner*—Willie G. Abercrombie
*Attorney, Agent, or Firm*—E. R. Benno; R. W. Beart

[57] ABSTRACT

A cutting mechanism which cooperates with certain types of package forming machines to produce packages of a plurality of containers. The certain package forming machines continuously deliver at least three rows of containers with a strip of applied carrier stock interconnecting the containers in rank and file to a cut-off station. The cutting mechanism mounted at the cut-off station includes a knife blade assembly that is rotated in timed relationship to the movement of the rows of containers with the applied carrier stock to cut the applied carrier stock between certain ranks which are between the side files of the containers. Cutting means are also provided for cutting the applied carrier stock on the side files of the containers between the same ranks where the carrier stock is cut by the knife blade assembly to form individual packages of a predetermined plurality of ranks of said containers.

7 Claims, 7 Drawing Figures

PACKAGE FORMING MACHINE

BACKGROUND OF THE INVENTION

The cutting mechanism of the subject invention cooperates with a system, machine and method for multipackaging containers as shown and described in the United States patent application of Benno et al, Ser. No. 583,079, filed June 2, 1975. The system, machine and method for multipackaging containers of that patent application is different from prior art machines in its teaching of the application of a strip or carrier stock to more than two adjacent rows of containers moving substantially continuously through the machine.

Cutting mechanisms of prior known systems, machines and methods teach various arrangements for cutting carrier stock of only two rows of containers. Such cutting mechanisms are shown, for example, in FIGS. 25 and 26 of United States Pat. No. 3,032,943; in FIGS. 12, 13 and 19 of U.S. Pat. No. 3,032,944; and in FIGS. 34 and 35 of U.S. Pat. No. 3,204,386. While the two row cutting mechanisms of the prior art may to some extent be modified for cutting applied carrier stock on more than two rows of containers, no obvious modifications are known that will provide for the continuous uninterrupted cutting of the carrier stock on more than two rows of containers where the container rows are continuously uninterruptedly being delivered from the applicating machine at relatively high speeds.

SUMMARY OF THE INVENTION

The basic cutting mechanism of the subject invention uniquely solves the problem of cutting the middle or intermediate rows of applied carrier stock between certain predetermined ranks of containers in relatively high speed continuously operating carrier applicating machines. Although the basic mechanism is shown and described for cutting the webs between ranks of a single center row of containers, those skilled in the art will understand that the mechanism can be duplicated for two or more intermediate rows of container applied carrier stock.

Briefly, the invention involves a rotating knife assembly mounted above the continuously moving files of containers with a strip of applied carrier stock. The rotating knife assembly, in one embodiment, rotates in a plane disposed at an angle of 45° to the line of movement of the container files. One or more knife blades are carried on the periphery of the rotating knife assembly to extend radially outwardly thereof. Each knife blade is disposed in a plane at an angle of 45° to the plane in which the knife assembly rotates so that when the knife assembly is rotated to a position where the knife blade extends vertically downwardly, the plane of the knife blade is perpendicular to the line of movement of the containers. At the vertically downward position of the knife blade, the blade intersects a horizontal plane through the webs of the carrier stock which interconnects adjacent ranks of the containers.

The rotating knife assembly is rotated in timed relation to the conveyor or other mechanism that moves the containers beneath the rotating knife assembly so that the spatial relationship of a knife blade to the moving containers is such that the knife blade will move downwardly between adjacent ranks of containers, will move horizontally through a web of the middle file of containers, and will thereafter move upwardly from between those adjacent ranks of containers. The circumferential spacing of the knife blades on the rotating knife assembly is correlated to the spacing between web centers of the applied carrier in the middle file of containers to cut the carrier webs of the middle file in any repeating desired pattern. Thus, every middle web may be cut or one, two or more webs may be left uncut before a knife blade makes another cut. In the embodiment shown in the drawings, the middle web after every fourth container in the middle file is the cut web. Further, in the embodiment shown in the drawings, the rotating knife assembly may be provided with three more knife blades in addition to the three shown to produce a cut web after every second container in the middle file.

A convenient and unique cooperation is provided in the present invention between the middle file cutting mechanism described above and the cutting mechanism for the side files of containers to which the carrier stock has been applied. The cutting mechanism for the side files is essentially the mechanism shown in FIG. 34 of U.S. Pat. No. 3,204,386, issued Sept. 7, 1965, to S. H. Creed et al, and described in that patent. That side file cutting mechanism comprises two wheels mounted in the applicating machine in a substantially horizontal plane on each side of the moving rows of containers to which the carrier stock has been applied. For convenience, those wheels may be called star wheels and the periphery of those wheels have arcuate pockets, in the present embodiment, for engaging the arcuate surfaces of the containers which in the embodiment shown are cylindrical. At certain ones of the peripheral junctions of adjacent arcuate pockets, radially reciprocating knives are provided for cutting the webs between certain adjacent containers in the side files of containers. The star wheels are rotated in timed relation to the center file cutting mechanism so that the knives of the star wheels cut the webs between containers of the same ranks cut by the knife or knives of the center file cutting mechanism. Close indexing between the operation of the star wheels and the center file cutting mechanism is more important that exact indexing between the cutting mechanisms and the carrier stock applicating mechanism because the carrier stock applicating mechanism may be slightly ahead or slightly behind in timing relative to the cutting mechanisms without any bad effect on the operation of the machine as those skilled in the art will understand.

For a clear understanding of the operation of applicating machines, with which the present invention cooperates, reference is made to the United States patent application to Benno et al, Ser. No. 583,079, fixed June 2, 1975.

The primary object of the present invention is to provide cutting mechanisms in applicating machines which apply a plastic carrier stock in a strip to move than two rows of containers, which cutting mechanisms will sever certain webs of the carrier stock between certain ranks of the containers to which the carrier stock has been applied.

Other objects and features of the invention will be apparent upon a perusal of the hereinafter following detailed description in conjunction with the drawings.

DETAILED DESCRIPTION OF THE PREFERRED EMBODIMENTS

Figure 2:
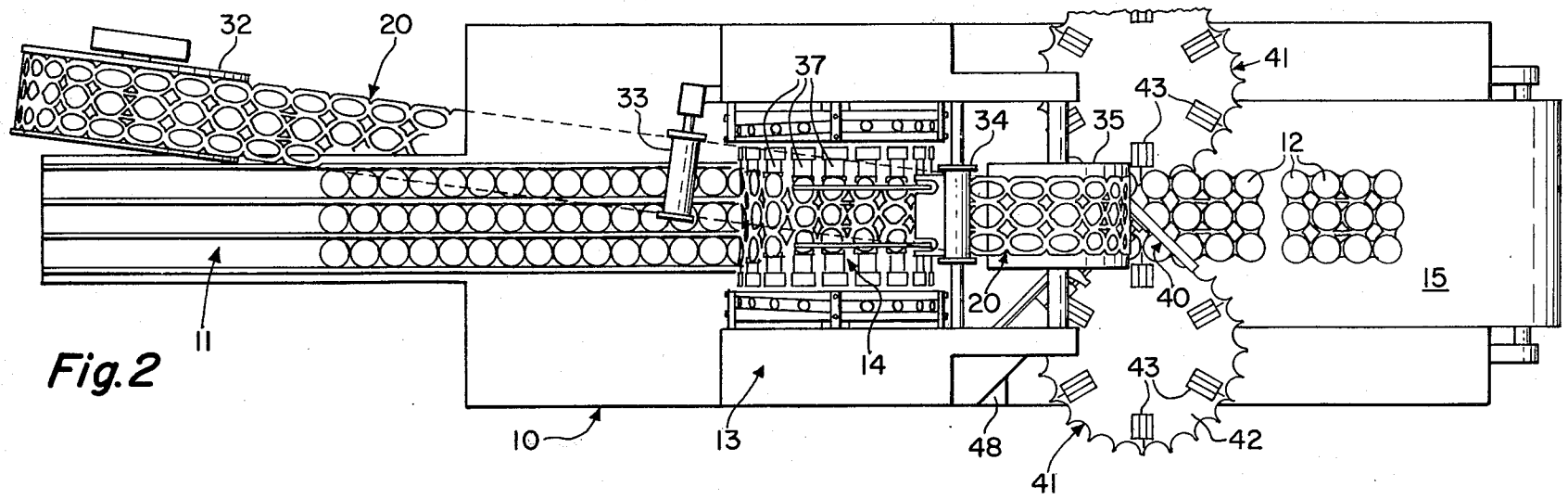
FIG. 2 is a top plan view of a machine of FIG. 1.
Figure 1:
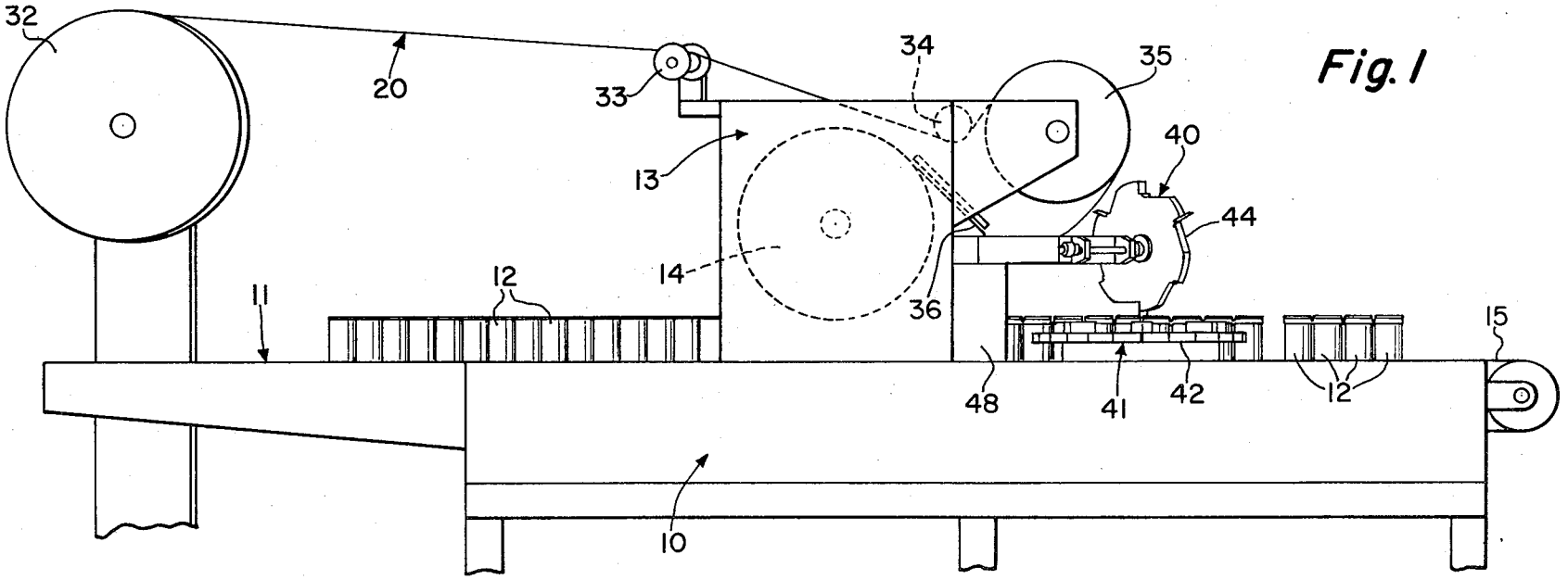
FIG. 1 is a side elevational view of one embodiment of an applicating machine embodying the subject invention.

The total machine as shown in FIGS. 1 and 2 is substantially exemplary in form and many of the parts, which are not critical to an understanding of the subject invention and for which known parts may be used, are only briefly shown.

The machine comprises a base 10 which may be constructed in any suitable known manner for supporting the operating elements of the machine. An input conveyor 11 of any suitable type is provided for delivering at least three adjacent rows of containers such as cans 12 to the work station 13 of the machine. Suitable known means may be provided in conjunction with the input conveyor 11 to move the three rows of containers 12, slightly spaced-apart and in accurate ranks and files, through the work station 13. The work station 13 comprises a drum assembly 14 mounted therein immediately above the three rows of cans 12 passing through the work station 12. The drum assembly 14 is further carried to rotate about a horizontal axis transversely of the three rows of cans 12. The machine further includes a suitable output conveyor 15 for receiving the three rows of cans 12 from the work station 13 with the carrier stock 20 applied thereto.

Figure 3:
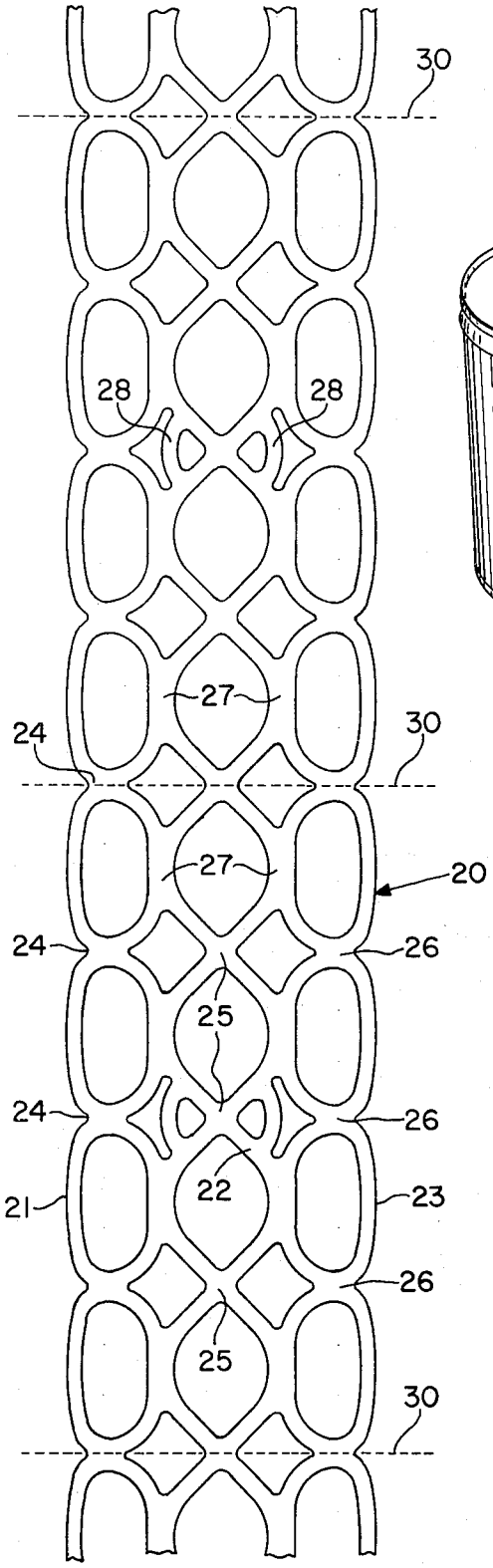
FIG. 3 is a plan view of one embodiment of a multipackaging carrier stock which may be used in practicing the subject invention.

One form of multipackaging strip or stock that is applied to the cans 12 by the applicating machine is shown in FIG. 3. That multipackaging strip, and other embodiments thereof, is shown and described in detail in the co-pending United States application of Mindaugas Julius Klygis, Ser. No. 581,591, filed May 29, 1975. The multipackaging strip 20 is made from a resilient plastic or plastics-material, such as low density polyethylene. The strip 20 comprises, in the embodiment shown in FIG. 3, three rows of bands 21, 22 and 23. The row of bands 21 are integrally interconnected by webs 24. The row of bands 22 are integrally interconnected by webs 25, and the row of bands 23 are integrally interconnected by webs 26. The three rows of bands 21, 22 and 23 are further integrally interconnected in a side-by-side arrangement by webs 27 with the row of bands 22 being disposed between the two side rows of bands 21 and 23.

Figure 4:
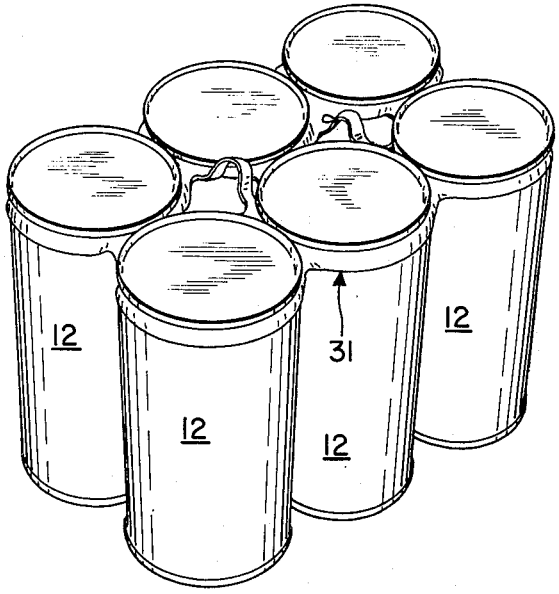
FIG. 4 is an isometric view of a multipackage of containers such as may be produced in the practice of the subject invention.

Straps or handle elements 28 are provided between two adjacent bands 22 as may be seen in FIG. 3. The straps 28 are located between every fourth pair of center bands 22. It thus may be seen that if the carrier strip or stock 20 is transversely severed through the webs 24, 25 and 26 along the lines 30 shown in FIG. 3 individual carriers for 12 cans 12 will be formed. With other locations of the strap elements 28, and with appropriate transverse severance of the carrier stock having such other strap locations, multipackages of other than 12 cans 12 may be produced. FIG. 4 shows a modified strip 31 on six cans 12 to produce a multipackage of six containers. Reference is made to the noted patent application of Mr. Klygis for a detailed understanding of various other embodiments of the carrier strip or stock 20.

Reference is further made to the noted patent application of Benno et al for a detailed understanding of the manner in which the machine of FIGS. 1 and 2 operates to apply the carrier stock 20 to the three rows of cans 12. Briefly, those skilled in the art will understand that the carrier stock 20 is taken from a reel 32, directed over and about appropriate guiding and indexing rollers, such as rollers 33, 34, and 35, to and into a carrier stock guide system 36. From the guide system 36, the carrier stock 20 is directed onto the jaw assemblies 37 of the drum assembly 14 in the work station 13. As the drum assembly 14 rotates, the three rows of bands 21, 22, and 23 are stretched for application to the cans 12. While drum assembly 14 is rotated, the three rows of cans 12 are fed beneath the drum assembly 14 in a timed relationship thereto, so that the stretched carrier stock 20 is applied to the cans 12 with each band 21, 22, and 23 encircling one of the cans 12 immediately below the upper edge or chime thereof. As the cans 12 move from beneath the rotating drum assembly 14, jaw assemblies 37 are drawn from the applied carrier stock 20 and the three rows of cans 12 with the applied carrier stock 20 proceed in a continuous arrangement to the cutting mechanism of the subject invention.

The cutting mechanism of the subject invention comprises the assembly 40 for cutting the webs 25 between the center row of bands 22, and the duplicate assemblies 41 for cutting the webs 24 and 26 of the two side rows of bands 21 and 23.

A description of a side cutting assembly such as the assembly 41, is shown in FIGS. 34 and 35 of U.S. Pat. No. 3,204,386 and is described in detail therein. Reference to that patent is made for an understanding of the details of such cutting assemblies. Briefly, each of the cutting assemblies 41 comprises a pocketed wheel 42 which is rotatively mounted for rotation about a vertical axis on one side of the rows of containers issuing from the carrier stock applicating portion of the machine. The pockets in the star wheel 42 are formed in the peripheral edge of the wheel and are shaped to match the circumferential profile of the containers. As the containers are cylindrical cans 12, the pockets are semicircular. As the star wheel 42 rotates, the cans of a side file will be received within and leave the pockets of the star wheel 42 along a line substantially tangent to the radially inward edge of the pockets of the star wheel 42. Advantageously, the spacing between adjacent pockets of the star wheel 42 may be such that the adjacent cans 12 of the side files are slightly spaced-apart in the line of the side files to slightly stretch the webs 24, 25, and 26 as the webs 24 and 26 are to be cut by the cutting mechanisms 41. Each star wheel 42 carries a plurality of knife assemblies 43. The knife assemblies 43 may be mounted either on the upper surface or the underside of the star wheels 42. Each of the knife assemblies 43 carries a knife which is mounted for horizontal reciprocation in a vertical plane directed radially of the star wheel 42. Means (not shown) are provided for reciprocating the knives of the knife assemblies 43 when each knife assembly 43 is indexed with a can 12 in each of the adjacent peripheral pockets. The number of knife assemblies 43 are selected and circumferentially arranged on the star wheels 42 to cut the carrier stock webs 24 and 26 at appropriate locations longitudinally of the applied carrier stock 20 to form individual packages of a selected number of cans 12. As may be seen in FIG. 2, a knife assembly 43 is provided after every fourth pocket to cut the webs 24 and 26 of the applied carrier stock 20 to form container multipackages of 12 cans 12. Obviously, the two cutting mechanisms 43 cut the webs 24 and 26 between the same ranks of containers 12 and the cutting mechanism 40 is also indexed and arranged to cut the webs 25 between the same ranks of containers 12.

The cutting mechanism 40 comprises a wheel 44 which is keyed to a shaft 45. The shaft 45 is rotatively carried by the pair of bearing blocks 46 which may be seen in FIG. 5. The bearing blocks 46 in turn are secured to a supporting member 47 and, as shown somewhat diagrammatically in FIGS. 1 and 2, the supporting member 47 is secured to the upper end of a box 48 which is mounted on the frame 10 of the machine. The box 48 and the supporting member 47 rotatively carry the shaft 45 at 45° angle to the line of movement of containers 12 between the star wheels 42 so that a vertical diameter of the wheel 44 lies in a vertical plane through an opposed pair of knife assemblies 43 which are positioned to cut the webs 24 and 26 of the side files of the applied carrier stock 20, as may be seen in FIG. 5.

Drive means (not shown) in the box 48 and in the base of the machine 10 are provided for driving both of the star wheels 42 and for rotating the shaft 45 to rotate the wheel 44 in a certain timed relationship.

The wheel 44 has a maximum diameter such that as it is rotated by the shaft 45 it clears the tops of the containers 12 passing therebeneath. The wheel 44 is further provided with a plurality of substantially V-shaped pockets each having a somewhat chordally extending wall 44*a* and a radially extending wall 44*b*. The radially extending wall 44*b* of each of the pockets is further disposed at an angle of substantially 45° to the plane of the wheel 44 to support a knife blade 50 thereagainst with the cutting edge of the knife blade extending radially outwardly of the wheel 44 a distance sufficient to cause the cutting edge to intersect a horizontal plane through the web 25 of the carrier stock 20 when the wheel 44 is rotated and a knife 50 passes through an arc of travel below the wheel 44. Because of the 45° angle of the wheel 44 to the line of movement of the containers 12 and the 45° angle of the knives 50 to the plane of the wheel 44, the plane of each knife 50 in intersecting the horizontal plane through the web 25, will be aligned in a vertical plane perpendicular to the line of movement of the containers 12 between the star wheels 42. It should be understood that other wheel angles and other knife angles may be used if the sum of the angles of any particular arrangement is substantially 90°.

In the embodiment of the invention shown in the drawings, the wheel 44 is provided with six pockets 44*a*, 44*b* equally spaced thereabout to carry six knives 50. However, in the set-up or arrangement shown in the drawings, only three knives 50 are provided in three of the pockets with 120° of circumferential spacing therebetween. That arrangement provides that as the wheel 44 is rotated and after one knife 50 cuts a web 25, four ranks of cans 12 pass beneath the wheel 44 until the next circumferentially carried knife 50 cuts another web 25.

The timed relationship of the wheel 44 to the star wheels 42 is such that as a knife 50 cuts a web 25 between two ranks of containers 12, a pair of opposed knife assemblies 43 on the star wheels 42 will cut the webs 24 and 26 between the same two ranks of containers 12. Thus, the applied carrier stock 20 is cut in a repeating pattern to form a multipackage of 12 containers arranged in three rows of four ranks. Obviously, the applied carrier stock 20 must be indexed relative the star wheels 42 and the wheel 44 so that a pair of handle straps 28 appears between the two center ranks of each multipackage of 12 containers.

Figure 5:
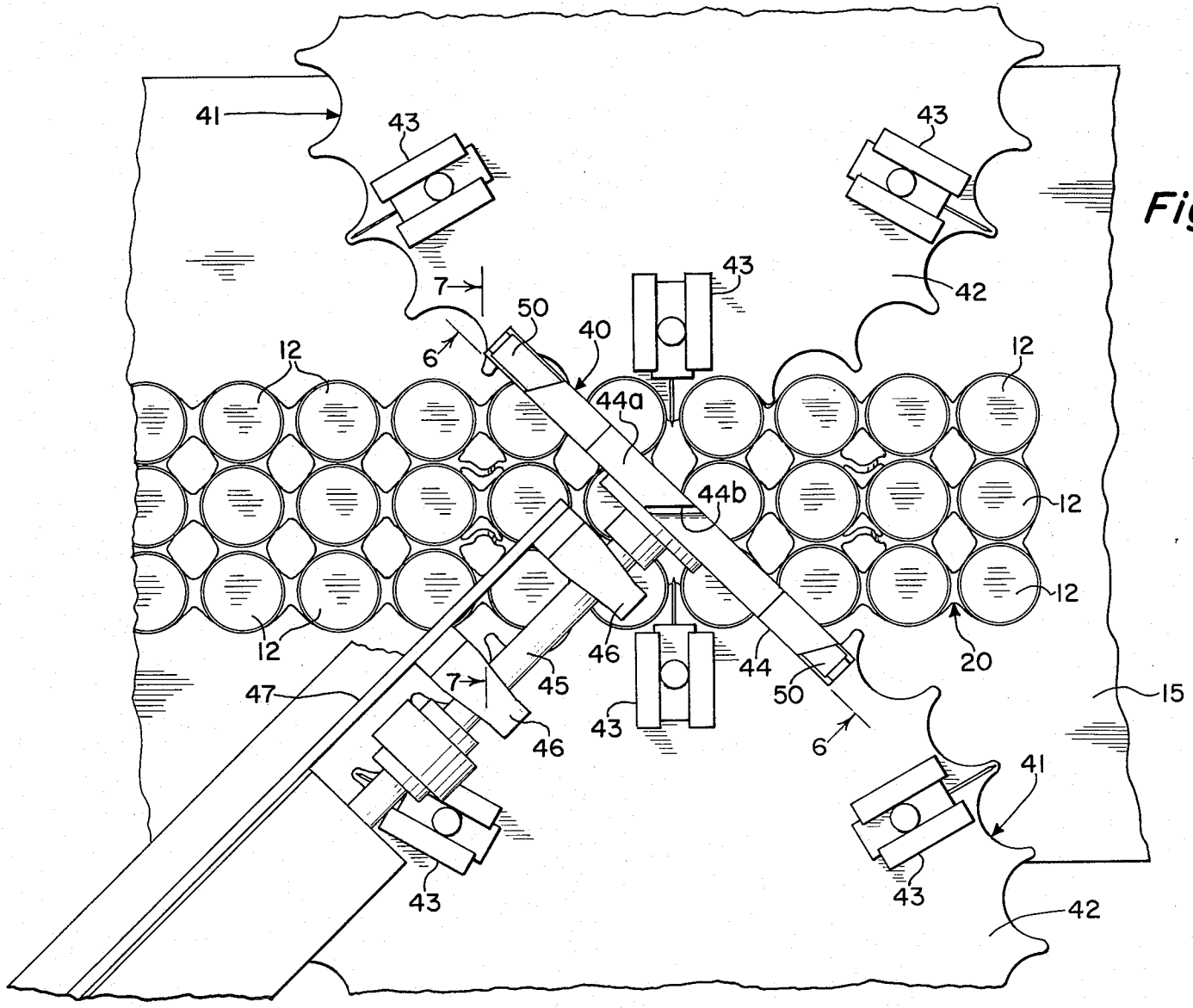
FIG. 5 is an enlarged fragmentary view of the cutting mechanism of FIG. 2.
Figure 6:
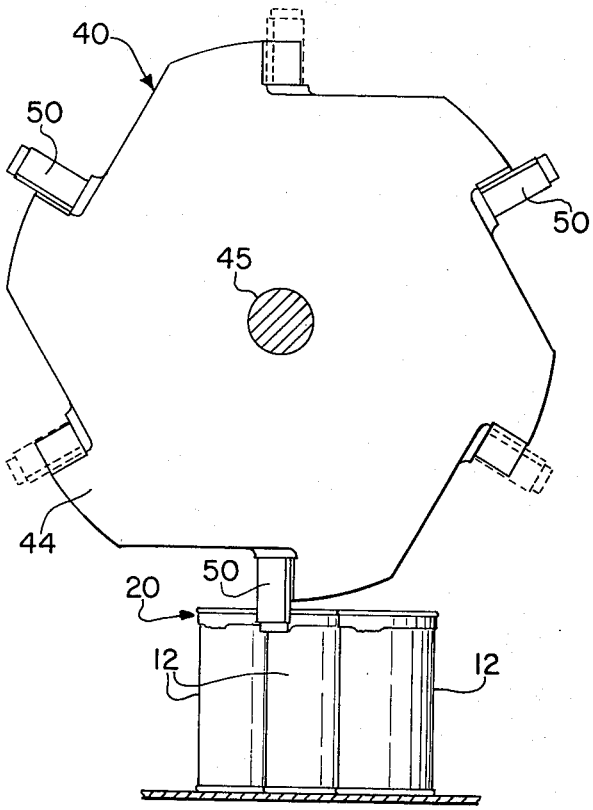
FIG. 6 is a side elevational view of a portion of the structure shown in FIG. 5 and taken substantially along the lines 6 — 6 of FIG. 5.
Figure 7:
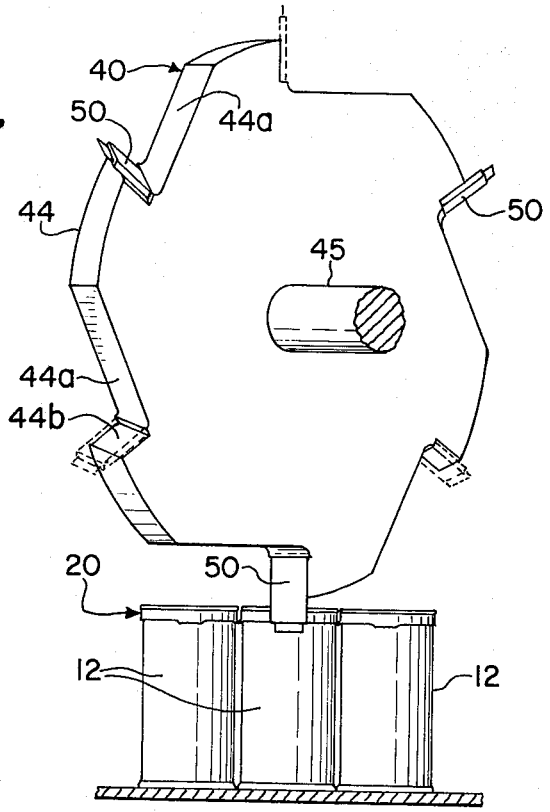
FIG. 7 is another elevational view of a portion of the structure shown in FIG. 5 and taken substantially along the lines 7 — 7 of FIG. 5.

If knives 50 are secured to the other three pocket walls 44*b* of the wheel 44, and if additional knife assemblies 43 are mounted on the star wheels 42 circumferentially midway between the knife assemblies 43 shown in FIG. 5, multipackages of six containers will be cut from the applied carrier stock 20 as the wheel 44 and the star wheels 42 are rotated. Such a multipackage is shown in FIG. 4, and obviously, a carrier stock for producing such multipackages would be provided with handle straps 28 after every two ranks of container encircling bands of the carrier stock.

Those skilled in the art will understand from the foregoing that an applied carrier stock of more than three rows can be cut to produce multipackages by an appropriate mounting of additional wheels 44 to cut the additional webs which are between the side files of containers 12. Those skilled in the art will further understand that a wheel 44 need not cut a web 25 at the same time that the webs 24 and 26 of the side files are cut. Under some conditions, one of the cuttings can lead or lag the other in time.

Having described the invention, it is to be understood that changes can be made in the described embodiments by one skilled in the art within the spirit and scope of the appended claims.

I claim:

1. In a package forming machine which continuously delivers at least three rows of containers with a strip of applied carrier stock interconnecting said containers in rank and file to a cut-off station, knife blade means rotatively mounted at said cut-off station, and means for rotating said knife blade means in continuously timed relationship to the movement of said at least three rows of containers at said cut-off station to cut said applied carrier stock between certain predetermined ranks which are between the side files of said containers.

2. In package forming machine as defined in claim 1, wherein said knife blade means includes a first knife, support means carrying said first knife for rotation about an axis disposed at a certain angle to said line of movement of said at least three rows of containers to said cut-off station, and means mounting said first knife on said support means at an angle to said axis of rotation to align said first knife at one rotated position of said first knife at an angle of substantially 90° to said line of movement of said at least three rows of containers to said cut-off station to cut said applied carrier stock.

3. In a package forming machine as defined in claim 2, wherein said knife blade means includes a plurality of knives in addition to said first knife, said support means carrying said first knife and said plurality of knives in a circle arrangement with said knives being circumferentially equally spaced about said circle for rotation about said axis, and the diameter of said circle and the circumferential spacing of said knives being dimensioned to cut said applied carrier stock in said continuously timed relationship successively between said certain predetermined ranks with said knives successively.

4. In a package forming machine as defined in claim 1, wherein said knife blade means includes a knife, support means carrying said knife for rotation about an axis disposed at an angle of substantially 45° to the line of movement of said at least three rows of containers to said cut-off station, and means mounting said knife on said support means at an angle of substantially 45° to said axis of rotation to align said knife at an angle of substantially 90° to said line of movement of said at least three rows of containers to said cut-off station to cut said applied carrier stock in one rotated position of said knife.

5. In a package forming machine as defined in claim 1, and cutting means mounted at said cut-off station on each side of the side files of said containers for cutting said applied carrier stock between certain adjacent containers of each of the side files of said containers.

6. In a package forming machine as defined in claim 5, and means for operating said cutting means on each side of side files of said containers in timed relationship to the rotation of said knife blade means to cut said applied carrier stock between the same certain predetermined ranks of said containers cut by said knife blade means.

7. In a package forming machine which continuously delivers three rows of containers with a strip of applied plastic carrier stock interconnecting said containers with plastic webs therebetween in rank and in three files to and through a cut-off station, knife blade means rotatively mounted at said cut-off station above said three rows of containers passing through said cut-off station, and means for rotating said knife blade means in continuously timed relationship to the movement of said three rows of containers through said cut-off station to cut said plastic web between certain predetermined ranks of the center file of said containers.

* * * * *